US009314057B2

(12) United States Patent
Tatsuno et al.

(10) Patent No.: US 9,314,057 B2
(45) Date of Patent: Apr. 19, 2016

(54) GARMENT AND GARMENT MANUFACTURING METHOD

(75) Inventors: Isamu Tatsuno, Osaka (JP); Fumiaki Masaki, Osaka (JP); Takeshi Tatsuno, Osaka (JP); Hideo Takatori, Osaka (JP); Tetsuji Kasumi, Osaka (JP)

(73) Assignee: MONT-BELL CO., LTD., Osaka-shi (JP)

( * ) Notice: Subject to any disclaimer, the term of this patent is extended or adjusted under 35 U.S.C. 154(b) by 148 days.

(21) Appl. No.: 12/978,942

(22) Filed: Dec. 27, 2010

(65) Prior Publication Data

US 2011/0167539 A1 Jul. 14, 2011

(30) Foreign Application Priority Data

Jan. 12, 2010 (JP) ..... 2010-004283

(51) Int. Cl.
*A41D 31/00* (2006.01)
*A41D 27/10* (2006.01)
*A41D 1/04* (2006.01)

(52) U.S. Cl.
CPC .. *A41D 27/10* (2013.01); *A41D 1/04* (2013.01)

(58) Field of Classification Search
CPC ..... A41D 27/10; A41D 27/24
USPC ..... 2/59, 61, 123, 243, 268, 275; 66/177
See application file for complete search history.

(56) References Cited

U.S. PATENT DOCUMENTS 410,600 A * 9/1889 Mills ..... 66/172 R
RE16,460 E * 11/1926 Edwards ..... 474/265
1,727,586 A * 9/1929 Condon ..... 2/61
2,045,157 A * 6/1936 Mathias ..... 2/16
2,365,280 A * 12/1944 Lahm ..... 2/268
2,405,030 A * 7/1946 Glickman ..... 2/268
3,090,047 A * 5/1963 De Grazia ..... 112/425
3,146,468 A * 9/1964 McDonald ..... 2/239
3,985,003 A * 10/1976 Reed ..... 66/196
D279,937 S * 8/1985 Cohen ..... D2/717
4,832,010 A * 5/1989 Lerman ..... 602/63
5,020,164 A * 6/1991 Edwards ..... 2/239
5,450,630 A * 9/1995 Hale ..... 2/239
5,902,070 A * 5/1999 Bradley ..... 405/21
6,353,934 B1 * 3/2002 Tada et al. ..... 2/115

(Continued)

FOREIGN PATENT DOCUMENTS

JP A-03-206101 9/1991
JP A-08-60405 3/1996

(Continued)

OTHER PUBLICATIONS

Japanese Office Action mailed Nov. 29, 2011 issued in Japanese Patent Application No. 2010-004283 (with translation).

(Continued)

*Primary Examiner* — Nathan Durham
*Assistant Examiner* — Sally Haden
(74) *Attorney, Agent, or Firm* — Oliff PLC

(57) ABSTRACT

The fit of a garment is improved. An upper garment, which is a piece of clothing, has a sleeve portion, which is provided with a vertical seam line in the longitudinal direction and a horizontal seam line that extends to the vertical seam line from both directions with respect to the circumferential direction. The horizontal seam line has ends, which are located at different positions on the vertical seam line.

9 Claims, 10 Drawing Sheets

(56) References Cited

U.S. PATENT DOCUMENTS

| | | | |
|---|---|---|---|
| 7,631,366 | B2 | 12/2009 | Oyama et al. |
| 2007/0067892 | A1 | 3/2007 | Oyama et al. |

FOREIGN PATENT DOCUMENTS

| | | |
|---|---|---|
| JP | A-2000-239906 | 9/2000 |
| JP | B-3782441 | 3/2006 |
| JP | A-2008-169501 | 7/2008 |
| JP | A-2009-114566 | 5/2009 |

OTHER PUBLICATIONS

Knit Apparel III-Knit Factory; Fashion Industry Structure Improvement Association, First Edition published in Mar. 1997; p. 336; Fig. 3-173 (with English Translation).

* cited by examiner

GARMENT AND GARMENT MANUFACTURING METHOD

BACKGROUND

1. Field of the Invention

The present invention relates to a garment having a plurality of seams and a method of manufacturing the garment.

2. Description of Related Art

In the manufacture of garments, pieces of fabric cut into the shapes of respective parts are sewn with thread. As a result of this sewing, a plurality of seam lines are formed. Due to the nature of sewing in which parts are sewn sequentially, there may be the case, regarding a seam portion of a garment, where ends of a seam line are made to overlap with each other, and another seam line is formed over the overlap portion. More specifically, as shown in FIG. 10, in, for example, a sleeve portion 100 of an upper garment: a seam line 101 parallel to a cuff 100*a* is formed in the circumferential direction of the sleeve portion 100; ends 101*a*, 101*b* of the seam line 101 are made to overlap with each other; and a seam line 102 is formed over the overlap portion in the longitudinal direction of the sleeve portion 100.

Prior Art Reference Patent Document 1: JP2009-114566 A

SUMMARY

However, in the above-described garment, the ends 101*a*, 101*b* of the seam line overlap with the seam line 102, and thus the overlap portion is raised compared with the other portions. Therefore, for example, when or after a person wears the garment, the raised portion touches the skin of the person or is caught on another garment, which leads to the fit of the garment becoming deteriorated.

The present invention has been made in view of the above, and therefore has an object to improve the fit of a garment having a plurality of seams.

The present invention to attain the object above provides a garment having a plurality of seams, including: a first seam line; a second seam line that extends to the first seam line from one direction; and a third seam line that extends to the first seam line from an opposite direction to the one direction, wherein an end of the second seam line and an end of the third seam line are located at different positions on the first seam line.

According to the present invention, the end of the second seam line and the end of the third seam line are located at different positions on the first seam line. Thus, unlike the prior art, the ends of the seam lines do not overlap. This enables reduction of the rise of the overlap portion of the ends of the seam lines. Accordingly, the fit of the garment can be improved.

In the garment above, the second seam line and the third seam line may be continuous with each other.

Further, the second seam line and the third seam line continued with each other may be formed around a tubular portion of the garment in a circumferential direction of the tubular portion.

A fabric of the garment may have stretchability, and the second seam line and the third seam line may be formed to be oblique lines with respect to a main stretch direction of the fabric. In such a case, sufficient fabric stretchability of the portion in the periphery of each of the seam lines is ensured. Thus, when a person wears the garment, the person does not feel tightness at some parts of the garment, leading to a satisfactory fit of the garment. Further, the seam lines are each linear, and thus, the unevenness of the seam line is reduced, leading to a more satisfactory fit of the garment.

A fabric of the garment may have stretchability, and the second seam line and the third seam line may be bent. In such a case, sufficient fabric stretchability of the portion in the periphery of each of the seam lines is ensured. Thus, when a person wears the garment, the person does not feel tightness at some parts of the garment, leading to a more satisfactory fit of the garment. Note that the word "bend" herein encompasses not only curves but also lines combined with curves and lines having folded parts.

The present invention according to another aspect provides a garment having a tubular portion, the garment including a seam line that is formed around the tubular portion in a circumferential direction thereof, wherein ends of the seam line are located at positions that do not overlap with each other.

According to the present invention, the ends of the seam line of the tubular portion are located at positions that do not overlap with each other. This enables reduction of the rise of the overlap portion of the ends of the seam line, the rise having been found in the prior art. Accordingly, the fit of the garment can be improved.

The present invention according to another aspect provides a method of manufacturing a garment, including the steps of: providing a fabric of the garment; and sewing the fabric at a plurality of portions thereof, wherein the sewing step is carried out such that an end of a second seam line that extends to a first seam line from one direction and an end of a third seam line that extends to the first seam line from an opposite direction to the one direction are located at different positions on the first seam line.

According to the present invention, the end of the second seam line and the end of the third seam line are located at different positions on the first seam line. Thus, unlike the prior art, the ends of the seam lines do not overlap. This enables reduction of the rise of the overlap portion of the ends of the seam lines. Accordingly, the fit of the garment can be improved.

According to the present invention, the fit of a garment can be improved.

DETAILED DESCRIPTION OF PREFERRED EMBODIMENTS

Figure 1:
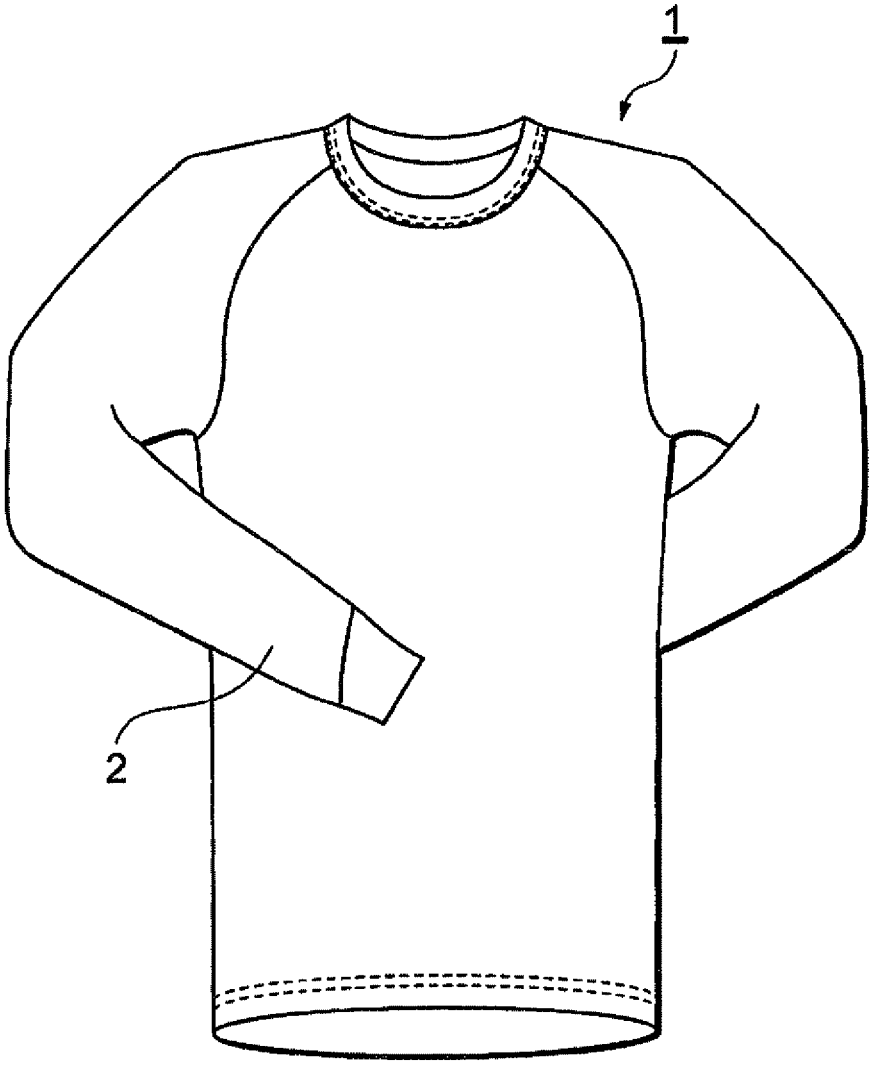
FIG. 1 is a view showing an upper garment according to an embodiment of the invention.

A preferred embodiment of the present invention will hereinafter be described with reference to the accompanying drawings. FIG. 1 is an explanatory view of an example of an upper garment 1, which is a piece of clothing, according to an embodiment of the present invention.

Figure 2:
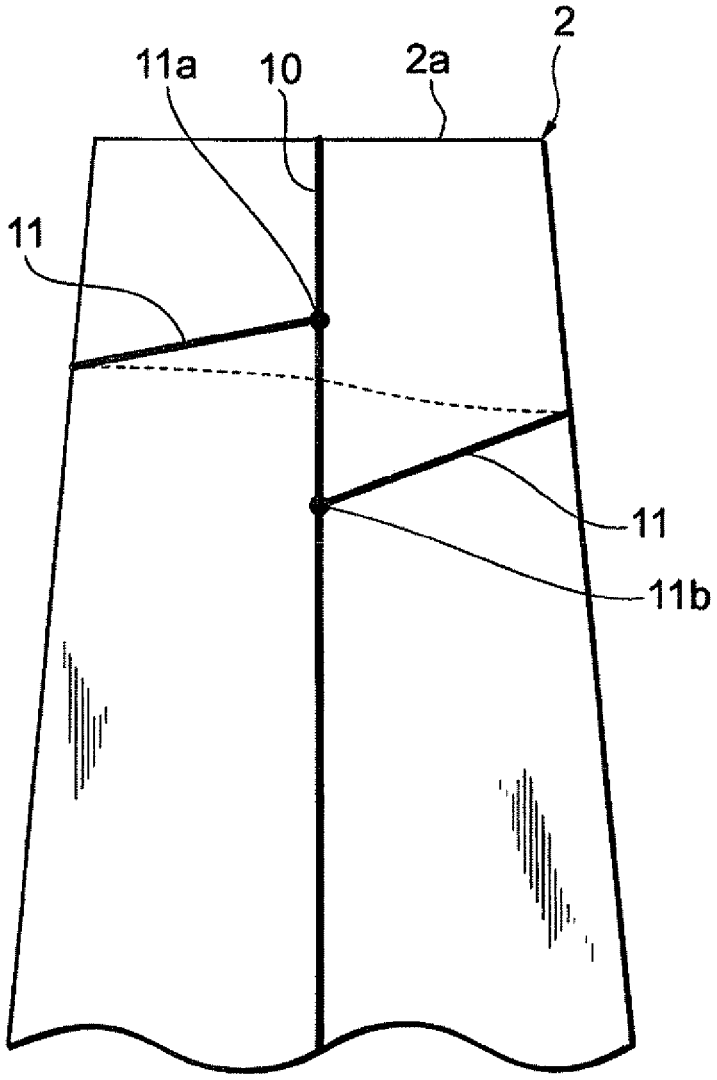
FIG. 2 is an enlarged view of a sleeve portion of an upper garment.

The upper garment 1 is formed by sewing, for example, a plurality of pieces of fabric cut into the shapes of respective parts. The upper garment 1 is made using fabric having, e.g., stretchability. FIG. 2 is an enlarged view of the part in the vicinity of the end of a sleeve portion 2 in the garment 1 in FIG. 1. The sleeve portion 2 is an example of a tubular portion of the upper garment 1. In the sleeve portion 2, for example, a vertical seam line 10, which serves as a first seam line, extending from a cuff 2*a* toward a shoulder, and a horizontal seam line 11, which serves as a second seam line and a third seam line, in the circumferential direction of the sleeve portion 2, are formed. The horizontal seam line 11 makes a circuit of the sleeve portion 2 in its circumferential direction from the vertical seam line 10 back to the vertical seam line 10. More specifically, the horizontal seam line 11 has an end 11*a*, on the vertical seam line 10, to which a part of the horizontal seam line 11 extends from one direction (left in FIG. 2), and has an end 11*b*, on the vertical seam line 10, to which another part of the horizontal seam line 11 extends from an opposite direction to the one direction (right in FIG. 2), and the vertical seam line 10 is formed over these ends 11*a*, 11*b*. The horizontal seam line 11 is formed to be, for example, an oblique line with respect to the direction of the fabric (direction of the weave pattern) parallel or perpendicular to the cuff 2*a*, and both the ends 11*a*, 11*b* of the horizontal seam line 11 are located at different positions on the vertical seam line 10.

Figure 3:
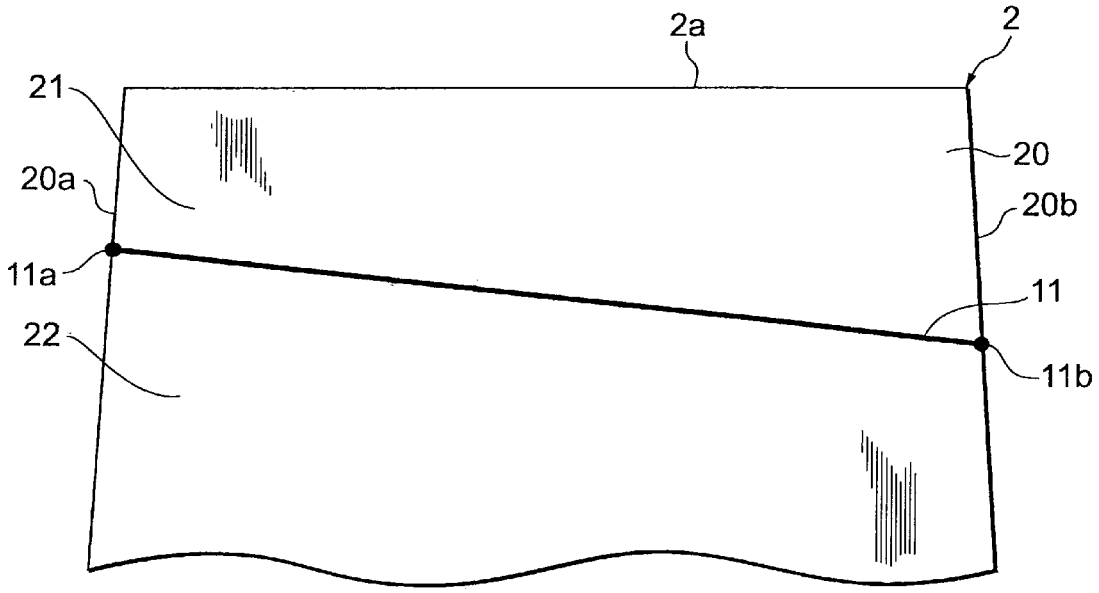
FIG. 3 is a development view of a sleeve portion.
Figure 4:
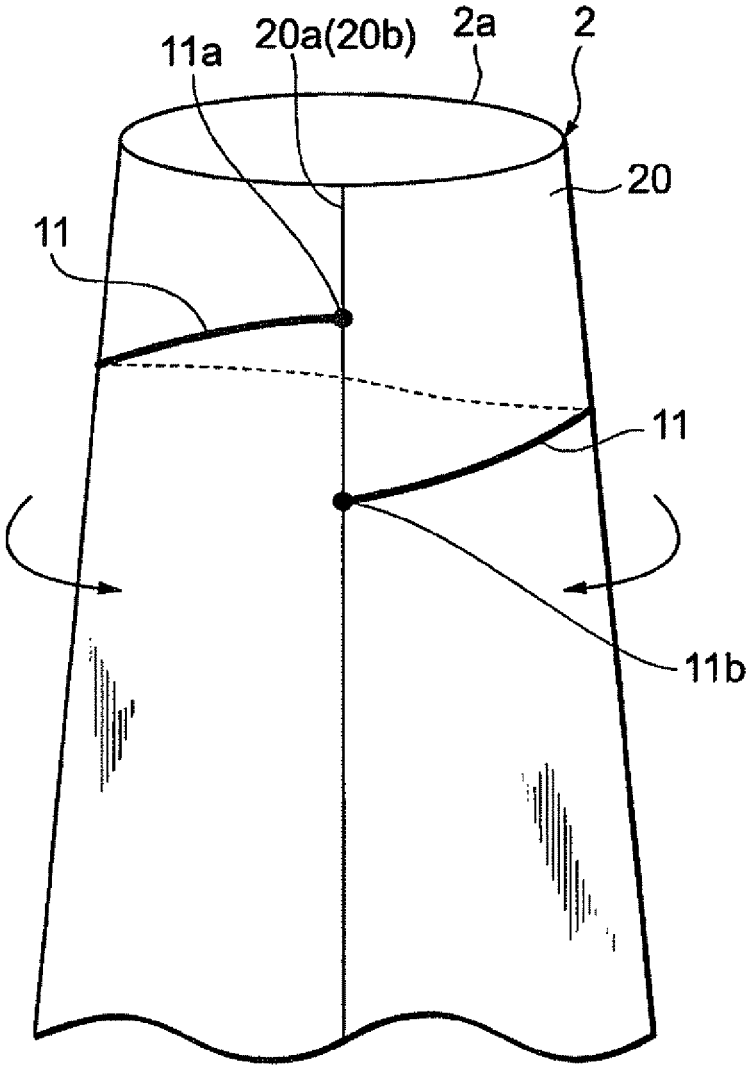
FIG. 4 is a view showing the state where side edges of a fabric that constitutes a sleeve portion touch each other.

When manufacturing the upper garment 1, for example, a fabric 20 developed as shown in FIG. 3 is provided, and the fabric 20 is sewn so that the horizontal seam line 11 inclined with respect to a main stretch direction (fabric direction) of the fabric 20 is formed. The fabric 20 has a first fabric portion 21 and a second fabric portion 22 directly adjacent to the horizontal seam line 11 and on opposing sides of the horizontal seam line 11 that are seamed by the horizontal seam line 11. The contact points of side edges 20*a*, 20*b* of the fabric 20 with respect to the horizontal seam line 11 serve as the ends 11*a*, 11*b*, respectively. After that, as shown in FIG. 4, the fabric 20 is rolled up such that the side edges 20*a*, 20*b* overlap, and then, the side edges 20*a*, 20*b* are sewed together, thereby forming the vertical seam line 10 that passes through the ends 11*a*, 11*b* of the horizontal seam line 11, as shown in FIG. 2.

According to the embodiment above, both the ends 11*a*, 11*b* of the horizontal seam line 11 are located at different positions on the vertical seam line 10. Thus, unlike the prior art, the ends of the seam line do not overlap. This enables reduction of the rise of the overlap portion of the ends of the seam line. Accordingly, the fit of the upper garment 1 can be improved.

Figure 5:
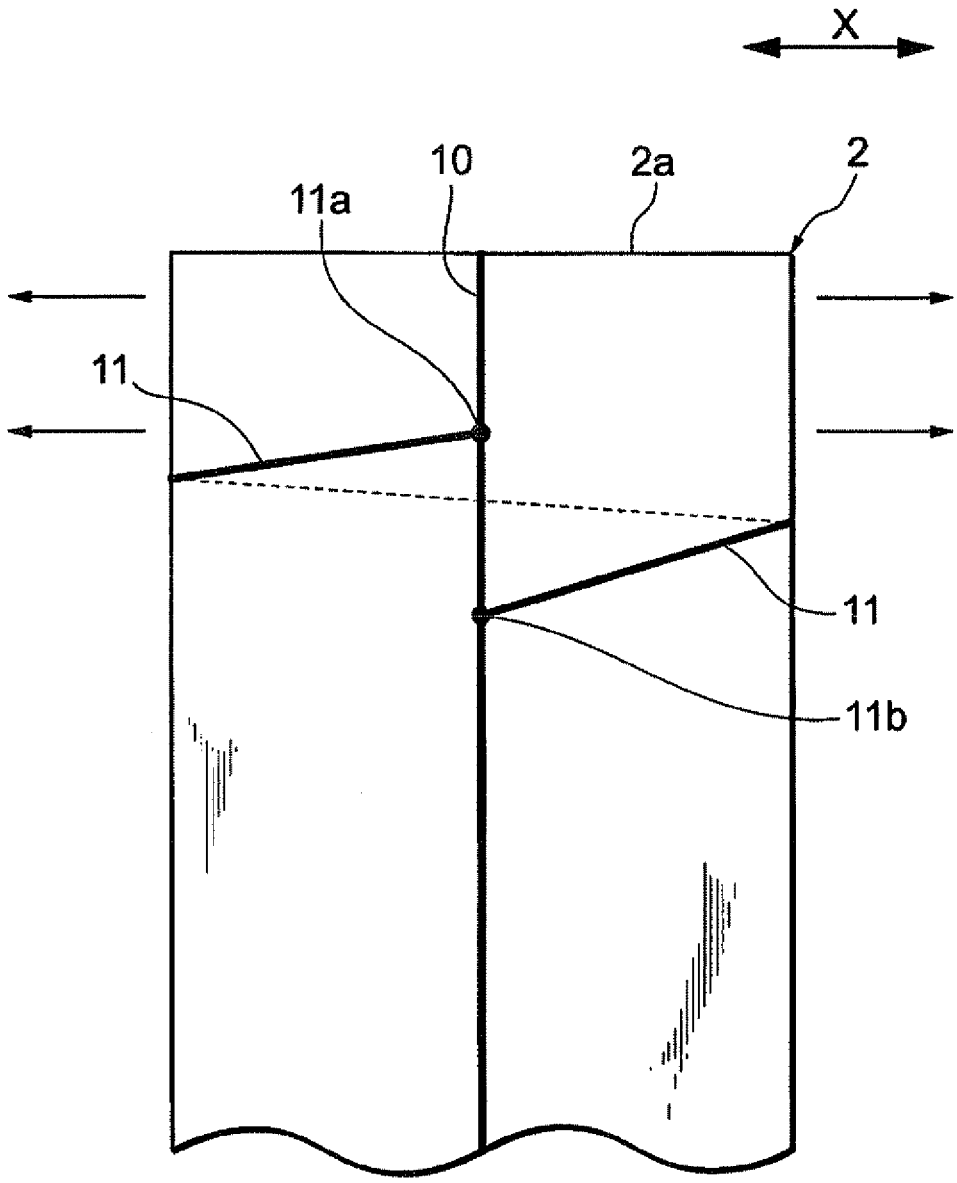
FIG. 5 is an enlarged view of a sleeve portion in the state where the fabric that constitutes the sleeve portion is expanded to the right and to the left.

The fabric 20 has stretchability, and the horizontal seam line 11 is formed to be an oblique line with respect to the fabric direction, which is the main stretch direction of the fabric 20. The horizontal seam line 11 by itself has less stretchability than the other portions (portions in the fabric 20); however, the horizontal seam line 11 is oblique with respect to the fabric direction. Thus, when the sleeve portion 2 is stretched in the horizontal direction (X-direction in FIG. 5), which is the fabric direction, as shown in FIG. 5, the horizontal seam line 11 is pulled in the fabric direction to be rotated, and the length in the horizontal direction of the horizontal seam line 11 increases accordingly, which suits the expansion of the sleeve portion 2. Further, when the sleeve portion 2 returns to its original length, the horizontal seam line 11 returns to its original angle, and the length in the horizontal direction of the horizontal seam line 11 decreases accordingly, which suits the contraction of the sleeve portion 2 as well. As a result, for example, when a person wears the upper garment 1, or is physically active after wearing the upper garment 1, satisfactory stretchability of the upper garment 1 is ensured also in the periphery of the horizontal seam line 11, leading to a satisfactory fit of the upper garment 1. Moreover, the horizontal seam line 11 is linear, and thus, the unevenness of the seam line is reduced compared to a curved seam line, leading to a satisfactory fit of the garment. This effect is large, in particular, where a sewing method, such as a flat seamer method or double-sided decorative stitching, in which unevenness tends to be caused easily in a seam portion due to the concentration of threads, is employed.

Although the preferred embodiment of the present invention has been described above with reference to the accompanying drawings, the present invention is not limited to this embodiment. It is obvious that a person skilled in the art could think of various alternative embodiments or modifications within the range of the idea of the claims, and the alternative embodiments and modifications can be understood as certainly falling within the technical scope of the present invention.

In the embodiment above, the seam line that extends to the vertical seam line 10 from one direction and the seam line that extends to the vertical seam line 10 from an opposite direction to the one direction form the horizontal seam line 11 with respect to the vertical seam line 10. Alternatively, for example, the seam lines with respect to the vertical seam line 10 may be separate horizontal seam lines as in the case where the sleeve portion 2 has a plurality of vertical seam lines 10.

Further, the horizontal seam line 11 may have other shapes. The horizontal seam line 11 may be a bent one. FIGS. 6 to 9 show examples of a variety of horizontal seam lines 11.

Figure 6:
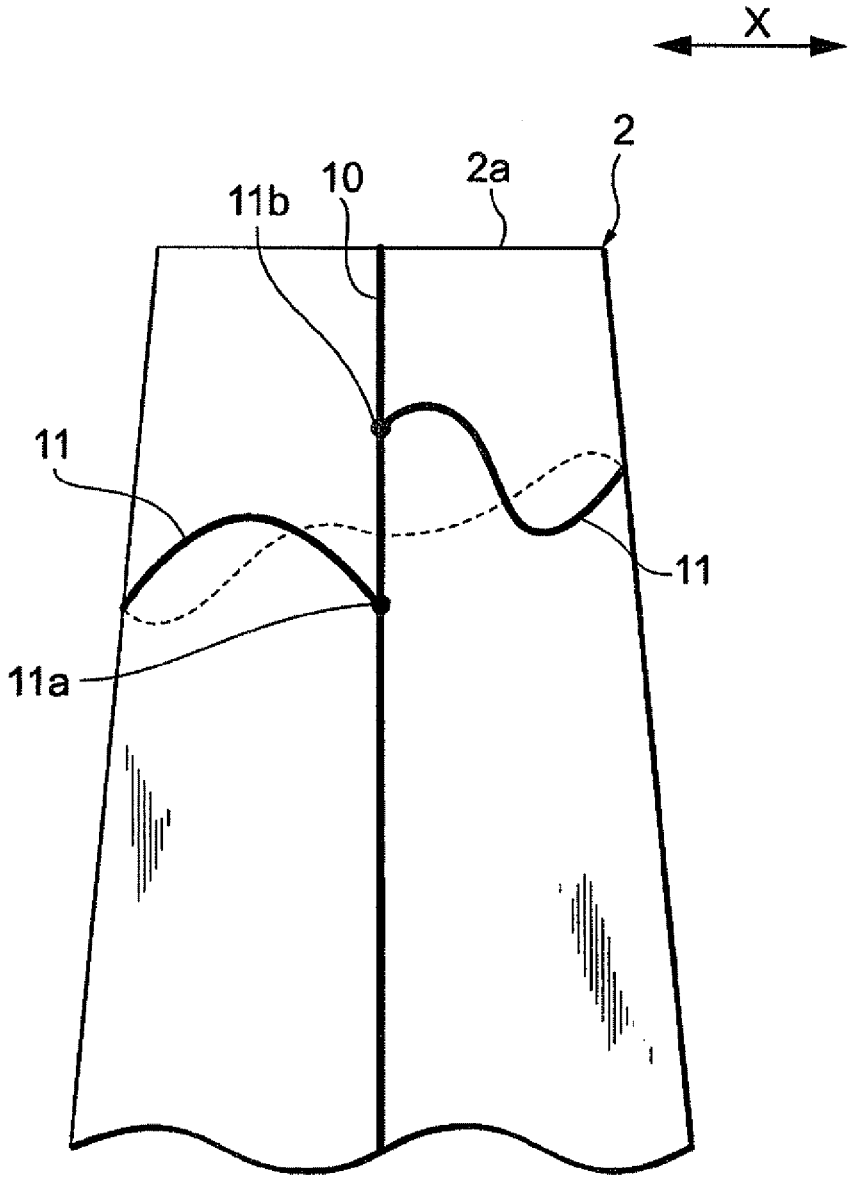
FIG. 6 is an enlarged view of a sleeve portion having a wave-shape horizontal seam line.
Figure 7:
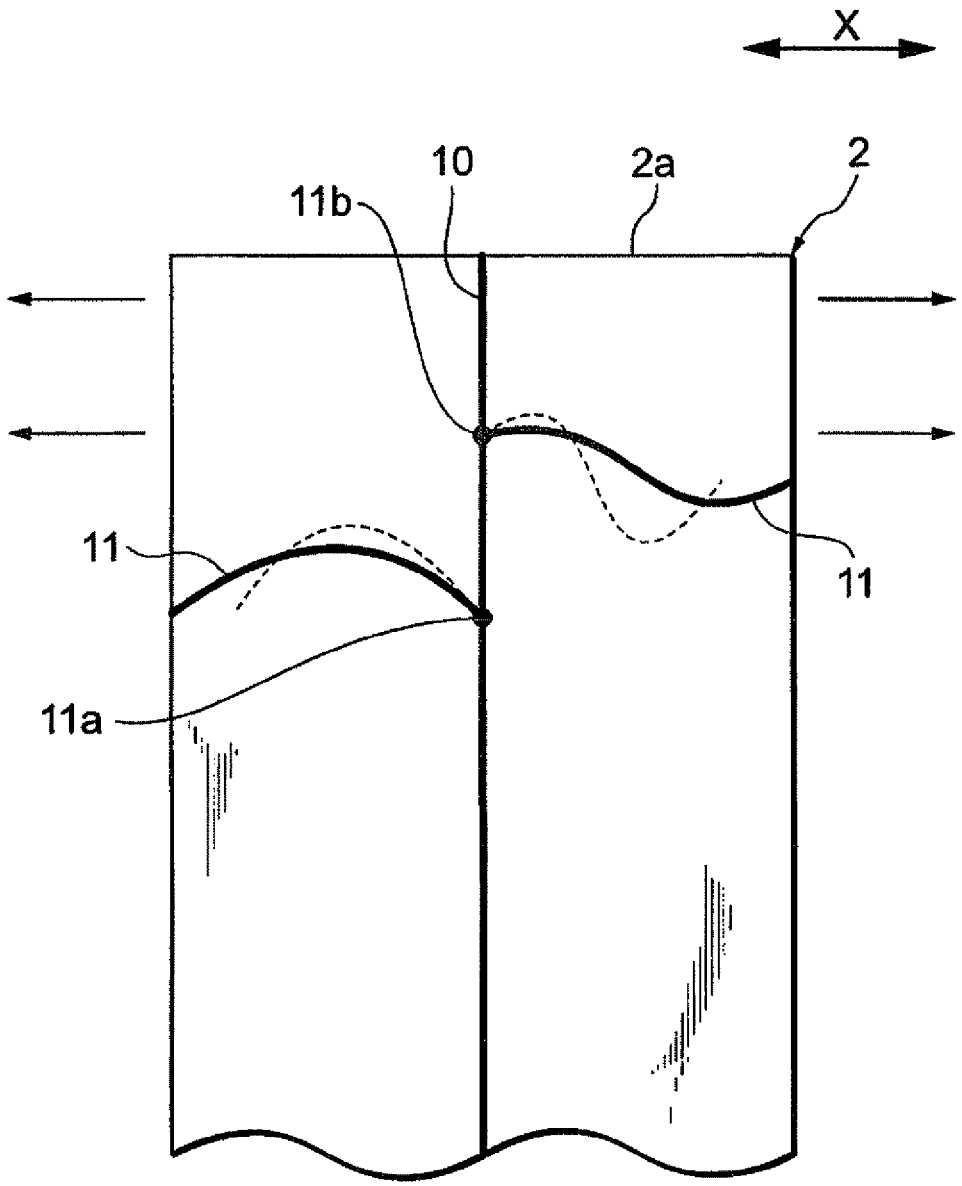
FIG. 7 is an enlarged view of a sleeve portion in the state where the fabric that constitutes the sleeve portion is expanded to the right and to the left, the fabric having a wave-shape horizontal seam line.

FIG. 6 shows the horizontal seam line 11 having a wave shape. In this case, for example, when the sleeve portion 2 is stretched in the horizontal direction (X-direction in FIG. 6), the curved horizontal seam line 11 deforms linearly, as shown in FIG. 7, and the length in the horizontal direction of the horizontal seam line 11 increases accordingly, which suits the expansion of the sleeve portion 2. Further, when the sleeve portion 2 returns to its original length, the horizontal seam line 11 returns to its original curved shape, and the length in the horizontal direction of the horizontal seam line 11 decreases accordingly, which suits the contraction of the sleeve portion 2 as well. As a result, for example, when a person wears the upper garment 1, or is physically active after wearing the upper garment 1, satisfactory stretchability of the upper garment 1 is ensured also in the periphery of the horizontal seam line 11, leading to a satisfactory fit of the upper garment 1. In this case, the horizontal seam line 11 provides the sleeve portion 2 with a characteristic pattern, resulting in excellent design. Note that the wave shape of the horizontal seam line 11 may not have a regular width or cycle.

Figure 8:
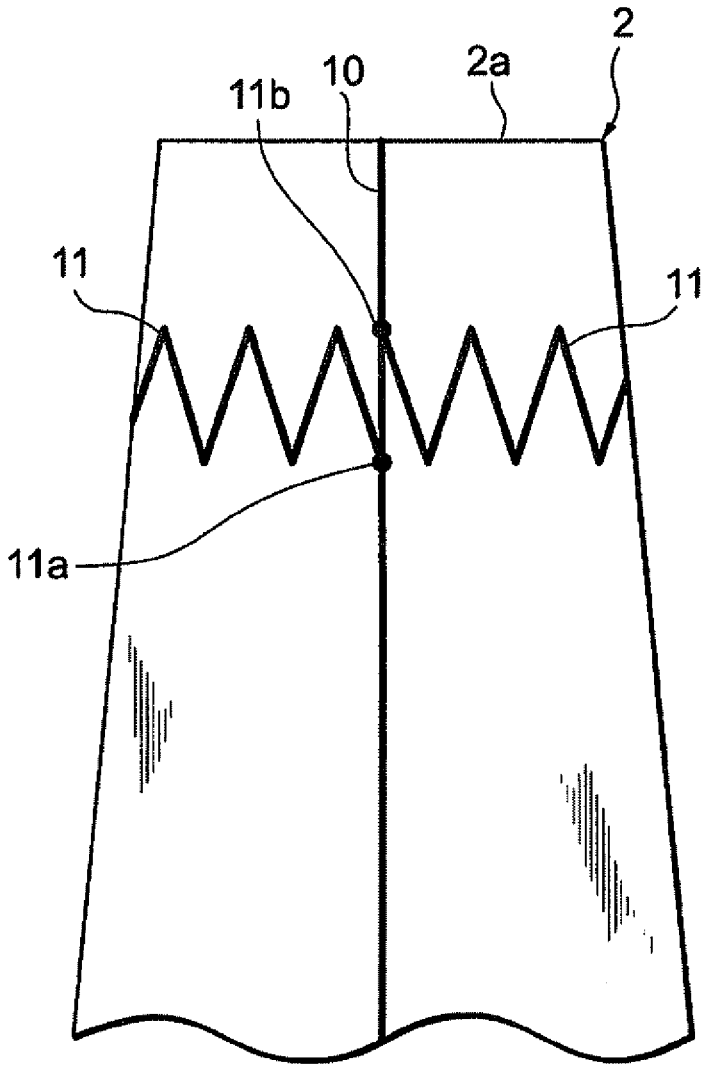
FIG. 8 is an enlarged view of a sleeve portion having a zigzag horizontal seam line.

FIG. 8 shows the horizontal seam line 11 that is folded to have a zigzag shape (sawtooth shape). This case can also suit the expansion and contraction of the sleeve portion 2, leading to a satisfactory fit of the upper garment 1. Further, the horizontal seam line 11 provides the sleeve portion 2 with a characteristic pattern, resulting in excellent design. Note that the zigzag shape of the horizontal seam line 11 may not have a regular swing or cycle.

Figure 9:
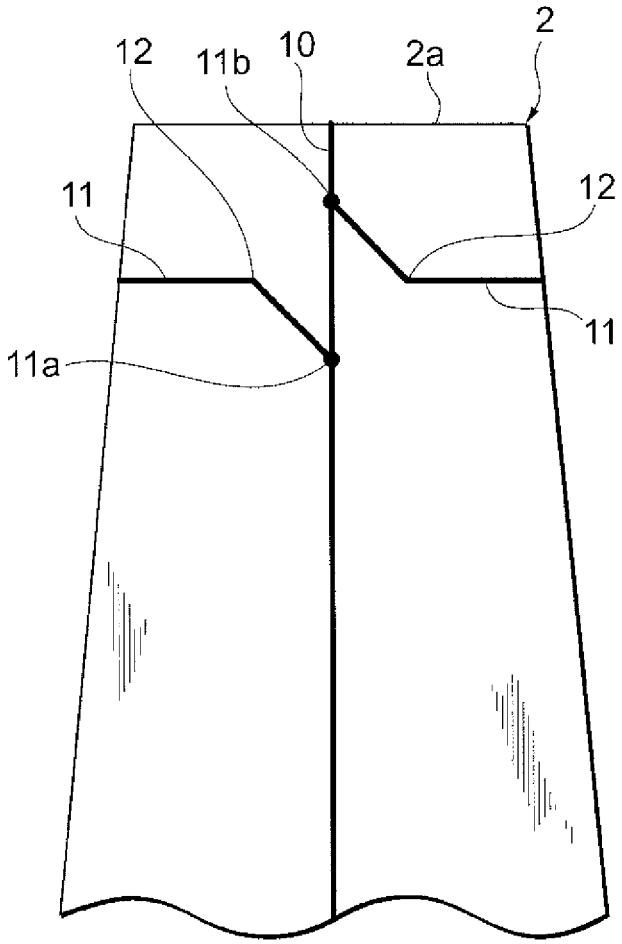
FIG. 9 is an enlarged view of a sleeve portion having a horizontal seam line having a shape in which a line is folded.
Figure 10:
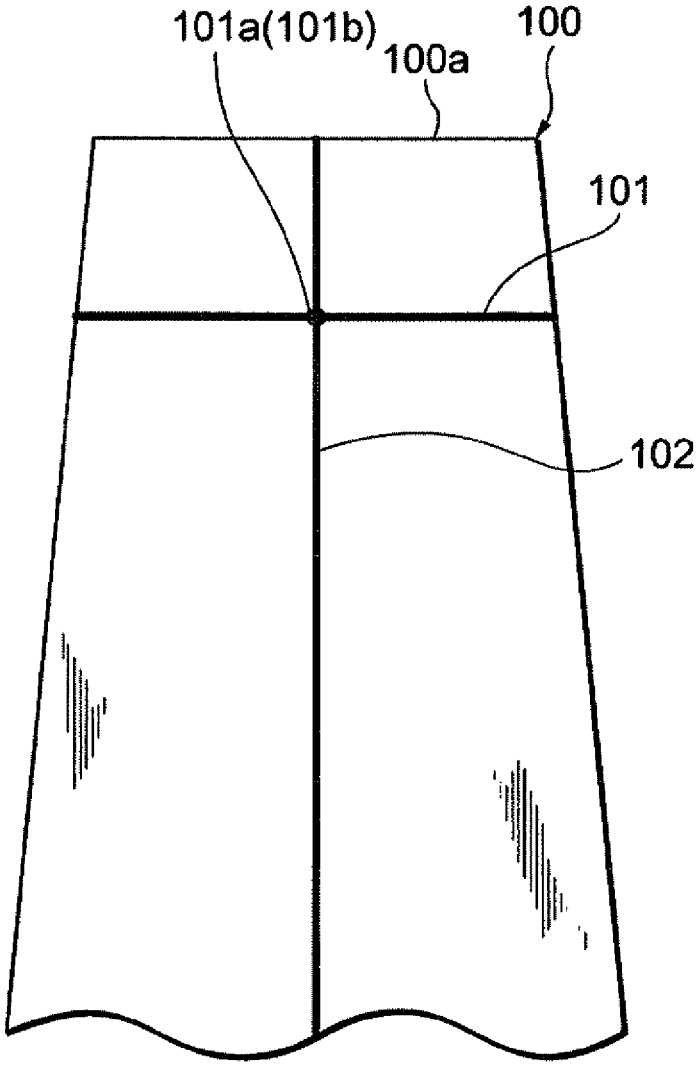
FIG. 10 is a view showing a sleeve portion of an upper garment before improvement.

FIG. 9 shows the horizontal seam line 11 in which a line parallel to the cuff 2*a* is folded at a point 12 on the line. This case can also suit the expansion and contraction of the sleeve portion 2, leading to a satisfactory fit of the upper garment 1. Further, the horizontal seam line 11 provides the sleeve portion 2 with a characteristic pattern, resulting in excellent design. Note that the positions and number of folded portions of the horizontal seam line 11 in this case may be arbitrarily selected.

Although the seam lines of the sleeve portion 2 in the upper garment 1 have been described in the embodiment above, the present invention may also be applied to the seam lines of the other portions in the upper garment 1, such as a collar portion and a main portion. The garments to which the present invention is applied are not limited to the upper garment 1 described above, and may also be other upper garments such as sweat shirts (including sweats), T-shirts, sweaters and underclothes (underwear). The present invention is not limited to upper garments, and may also be applied to lower garments such as pants and underclothes, and any other garments such as gloves, socks, wristbands, hats, neck warmers, arm warmers, leg warmers and sleeping bags. Note that the present invention attains a reduced rise made by the ends of the seam line, leading to a satisfactory fit of, in particular, the garments that touch human skin, such as underwear.

The present invention is useful in improving the fit of a garment.

What is claimed is:

1. A garment having a plurality of seams, comprising:

a first seam line;

a second seam line that extends to the first seam line from one direction; and a third seam line that extends to the first seam line from an opposite direction to the one direction, wherein the first seam line, the second seam line, and the third seam line are sewn with thread, an end of the second seam line and an end of the third seam line are located at different positions on the first seam line, the second seam line and the third seam line are directly continuous with each other, the second seam line and the third seam line are formed around a tubular portion in a circumferential direction thereof, a fabric having a main stretch direction, said fabric comprising a first fabric portion and a second fabric portion, said first fabric portion and said second fabric portion directly adjacent to the second seam line and the third seam line and on opposing sides of the second seam line and third seam line, said first fabric portion and said second fabric portion being seamed by the second seam line and the third seam line, said main stretch direction being in an orthogonal direction with respect to the first seam line, and the second seam line and the third seam line define lines that are oblique with respect to the main stretch direction.

2. The garment according to claim 1, wherein a portion of the garment defines at least one opening that, when the garment is in use, is adapted to be disposed around a user's neck or a user's waist.

3. A method of manufacturing a garment, comprising the steps of:

providing a fabric of the garment; and sewing the fabric at a plurality of portions thereof, wherein the sewing step is carried out such that an end of a second seam line that extends to a first seam line from one direction and an end of a third seam line that extends to the first seam line from an opposite direction to the one direction are located at different positions on the first seam line, the first seam line, the second seam line, and the third seam line are sewn with thread, the second seam line and the third seam line are directly continuous with each other, the second seam line and the third seam line are formed around a tubular portion in a circumferential direction thereof, the fabric having a main stretch direction, said fabric comprising a first fabric portion and a second fabric portion directly adjacent to the second seam line and the third seam line and on opposing sides of the second seam line and third seam line, said first fabric portion and said second fabric portion being seamed by the second seam line and the third seam line, said main stretch direction being in an orthogonal direction with respect to the first seam line, and the second seam line and the third seam line define lines that are oblique with respect to the main stretch direction.

4. The method of manufacturing a garment according to claim 3, further comprising:

creating at least one opening in the garment that, when the garment is in use, is adapted to be disposed around a user's neck or a user's waist.

5. A garment having a plurality of seams, comprising:

a first seam line;

a second seam line that extends to the first seam line from one direction; and a third seam line that extends to the first seam line from an opposite direction to the one direction, wherein the first seam line, the second seam line, and the third seam line are sewn with thread, an end of the second seam line and an end of the third seam line are located at different positions on the first seam line, the second seam line and the third seam line are directly continuous with each other, the second seam line and the third seam line are formed around a tubular portion in a circumferential direction thereof, a fabric having a main stretch direction, said fabric comprising a first fabric portion and a second fabric portion directly adjacent to the second seam line and the third seam line and on opposing sides of the second seam line and third seam line, said first fabric portion and said second fabric portion being seamed by the second seam line and the third seam line, said main stretch direction being in an orthogonal direction with respect to the first seam line, and the second seam line and the third seam line define substantially bent lines that are oblique with respect to the main stretch direction.

6. The garment according to claim 5, wherein the second seam line and the third seam line define a wave shape.

7. The garment according to claim 5, wherein the second seam line and the third seam line define a sawtooth shape.

8. The garment according to claim 5, wherein the second seam line and the third seam line define a line parallel to a cuff portion that is folded at a point on the line such that the end of the second seam line and the end of the third seam line are located at different positions on the first seam line.

9. A method of manufacturing a garment, comprising the steps of:

providing fabrics of the garment; and sewing the fabrics at a plurality of portions thereof, wherein the sewing step is carried out such that an end of a second seam line extends to a first seam line from one direction and an end of a third seam line extends to the first seam line from an opposite direction to the one direction, said end of said second seam line and said end of said third seam line being located at different positions on the first seam line, the first seam line, the second seam line, and the third seam line are sewn with thread, the second seam line and the third seam line are directly continuous with each other, the second seam line and the third seam line are formed around a tubular portion in a circumferential direction thereof, the fabrics having a main stretch direction, said fabrics comprising a first fabric portion and a second fabric portion on opposing sides of the second seam line and third seam line, said first fabric portion and said second fabric portion being directly adjacent to the second seam line and the third seam line and said first fabric portion and said second fabric portion being seamed by the second seam line and the third seam line, said main stretch direction being in an orthogonal direction with respect to the first seam line, and the second seam line and the third seam line define substantially bent lines that are oblique with respect to the main stretch direction.

* * * * *